US007185430B2

(12) United States Patent
Ochiai

(10) Patent No.: US 7,185,430 B2
(45) Date of Patent: Mar. 6, 2007

(54) METHOD OF MANUFACTURING CONTACT SHEETS

(75) Inventor: Toshimasa Ochiai, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 464 days.

(21) Appl. No.: 10/774,572

(22) Filed: Feb. 9, 2004

(65) Prior Publication Data

US 2005/0115069 A1 Jun. 2, 2005

Related U.S. Application Data

(60) Provisional application No. 60/525,749, filed on Nov. 28, 2003.

(51) Int. Cl.
*H01R 43/16* (2006.01)

(52) U.S. Cl. ..... 29/874; 29/879; 29/884; 439/66; 439/591

(58) Field of Classification Search ..... 29/825, 29/827, 830–843, 829, 593, 592.1, 874–884; 439/591, 91, 66
See application file for complete search history.

(56) References Cited

U.S. PATENT DOCUMENTS 5,173,055 A 12/1992 Grabbe
5,297,967 A * 3/1994 Baumberger et al. ..... 439/66
6,045,367 A 4/2000 Maldonado
6,146,151 A 11/2000 Li
6,298,552 B1 10/2001 Li
6,719,569 B2 * 4/2004 Ochiai ..... 439/66
6,926,536 B2 * 8/2005 Ochiai ..... 439/66

* cited by examiner

*Primary Examiner*—Minh Trinh
(74) *Attorney, Agent, or Firm*—Burr & Brown

(57) ABSTRACT

A method of manufacturing contact sheets is provided, including the steps of providing an electrically conductive sheet to form a conductive member. The conductive member includes a plurality of adjacent contact members joined by a plurality of linking portions. At least one base sheet is provided having a plurality of openings formed therein. The conductive member is positioned and secured to at least one surface of the base sheet such the contact members are positioned in the openings. The contact members are processed to (i) sever the linking portions from adjacent contact members and (ii) to form extending contact portions having a predetermined configuration. The position of the linking portions prior to severing is such that opposing severed faces of the linking portions are separated from each other and the contact members are electrically insulated from one another.

14 Claims, 6 Drawing Sheets

METHOD OF MANUFACTURING CONTACT SHEETS

This application claims the benefit of U.S. Provisional Patent Application No. 60/525,749, filed on Nov. 28, 2003, the entirety of which is incorporated herein by reference.

FIELD OF THE INVENTION

This invention relates to a method of manufacturing contact sheets, more specifically, a method of manufacturing contact sheets that improves the efficiency of the manufacturing process.

BACKGROUND OF THE INVENTION

Along with increasing demands in recent years for miniaturization and higher speeds in the field of information processing machines, there have been advances with regard to narrowing the pitch of integrated circuits and grid arrays of pin terminals and in thinning of pin terminals. Likewise, in packaging of electronic parts such as integrated circuits, though direct soldering to boards is common, packaging using connectors and sockets in order to improve quality is increasing. Thus, there is an increasing need to make connectors and sockets thinner for packaging electronic parts in order to miniaturize information processing devices, and particularly, for use in portable electronic devices.

Presently, such contacts and sockets are thicker since the contacts, which are the portions that contact the pins of the electrical parts, are formed by punching using progressive metal dies and secured by press fitting each pin or line into an injection-molded housing. As such, they are not suitable for thinner devices. Likewise, along with miniaturization, as the walls of the plastic housings have become thinner, problems are associated with respect to the ability to injection mold thinner-walled housings and with respect to the strength of the thinner walls when securing the contacts.

Then, connectors and sockets which do not include contacts that are inserted in a three dimensional housing, and which instead include contacts arranged on a single film surface, were tried. Methods of injection molding film-type connectors and sockets by forming conductors in which contacts are linked and then inserting these conductors (U.S. Pat. Nos. 6,045,367 and 6,146,151) and a method of applying these to contact sheets were proposed. However, with these, a portion of the contact area was reduced by removing the linking portion (which linked the contacts with each other), and while there was a need to provide insulation between the contacts, there was a problem in that if portions of the contacts that are to be removed were provided, the minimum size of the contact size that is necessary to maintain a satisfactory spring load could not be guaranteed.

As a method of eliminating the process of removing the linking portion, there is a method of etching after attaching conductors to one side of a polyimide film in which numerous holes are provided (for example TAB, Tape Automated Bonding). The invention noted in U.S. Pat. No. 6,298,552 is an example of an application of that method. This method has a problem, however, in that the contacts peel off or otherwise come off during bending because the contact is bonded only by the strength of the surface connection. Likewise, there is also the problem that when polyimide is applied to one side and etching is done on the other surface, the cross-section becomes trapezoidal and since one edge would be sharpened, precision processing could not be performed and repeat durability would be decreased due to cracks generated at the sharpened edge. Furthermore, with this method, if the contacts were arranged in area arrays, only costly electroless plating could be used because individual contacts are electrically insulated.

SUMMARY OF THE INVENTION

It is an object of the present invention to provide a method of manufacturing contact sheets in which it is possible to satisfactorily maintain the contact spring load and moreover to improve the efficiency of the manufacturing process. The method of manufacturing contact sheets according to the present invention solves the problems discussed above.

According to a first aspect of the present invention, a method of manufacturing contact sheets is provided, comprising the steps of:

- providing at least one elastic, electrically conductive sheet;
- forming an electrically conductive member from the at least one electrically conductive sheet, the electrically conductive member including a plurality of contact members aligned in a first direction in a predetermined arrangement and joined to one another by a plurality of linking portions;
- providing at least one elastic, electrically insulative base sheet having a plurality of openings formed therein in a predetermined pattern corresponding to the predetermined arrangement of the contact members of the electrically conductive member;
- positioning and securing the electrically conductive member to at least one surface of the at least one base sheet such the contact members are positioned in the openings; and
- subjecting the contact members to a breaking off process to sever the linking portions and separate adjacent contact members from each other;
- wherein opposing severed faces of the linking portions are formed during the severing part of the subjecting step; and
- wherein the position of the linking portions prior to severing is such that the opposing severed faces are separated from each other.

According to one embodiment of the first aspect of the present invention, the breaking off process of the subjecting step comprises a bending process to form contact portions having a predetermined configuration extending from the openings of the at least one base sheet.

According to a second aspect of the present invention, a method of manufacturing contact sheets according to the first aspect is provided, wherein plating is applied to the electrically conductive part.

According to a third aspect of the present invention, a method of manufacturing contact sheets according to the first or second aspects is provided, wherein the width of the linking portion, measured in a direction that is substantially perpendicular to the first direction, is in a range of 0.3 to 2 times the thickness of the linking portion.

According to a fourth aspect of the present invention, a method of manufacturing contact sheets according to the first, second and third aspects is provided, wherein the electrically conductive sheet comprises beryllium copper.

Thus, because the configuration of the linking portion is such that the linking portion will sever due to the rupture stress generated in the linking portion at the time of bending the contact, there is no need to provide another process for severing the linking portion to singulate the contacts from one another and the efficiency of the manufacturing process can improved.

Additionally, adjacent contacts are separated from one another, and thus insulated from one another, merely by severing the linking portions, that is, without requiring that a significant portion of the contact area be removed, such that the effective size of the contact is not reduced and the contact can satisfactorily maintain a spring load. Furthermore, the electrical insulation between adjacent contacts is assured since the positions of the linking portions prior to severing are such that, after severing, a distance is maintained between the opposing severed faces of the linking portions by the breaking off processing so that the contacts are separated from each other and thus insulated.

BRIEF DESCRIPTION OF THE DRAWINGS

For a more complete understanding of the nature and objects of the present invention, reference should be made to the following detailed description of a preferred mode for practicing the present invention, read in connection with the accompanying drawings, in which.

DETAILED DESCRIPTION OF THE INVENTION

Figure 1:
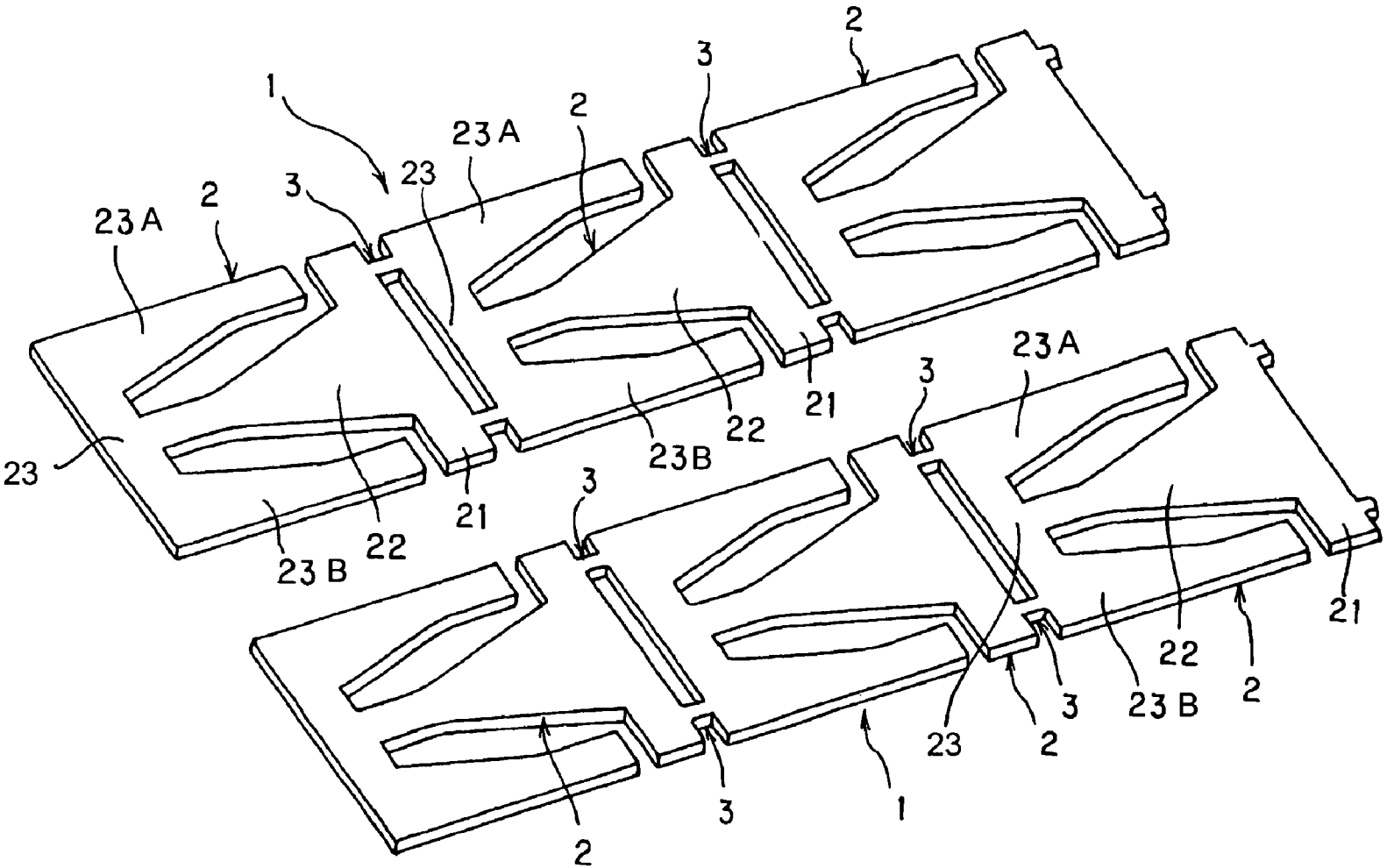
FIG. 1 is an oblique view showing a portion of the conductive material obtained in an intermediate stage of the method of manufacturing contact sheets according to the first embodiment of the present invention.

Next, embodiments of the present invention will be explained in detail with reference to drawings, but the present invention is not limited to the following embodiments. It should be understood that suitable modifications and improvements in design may be made by one of ordinary skill in the art without departing from the spirit of the present invention.

The reference symbols included in the drawings represent the following components:

1: conductive material;
2: contact (un-bent);
3: linking portion;
4: base sheet;
5: cut-out openings;
6: contact sheet;
7: contact (bent);
21: securing portion;
22: base portion;
23: beam portion;
23A, 23B: beam legs
31: severed face (securing portion side):
32: severed face (beam side); and
41: projecting portion.

According to a first embodiment of the present invention, a method of manufacturing contact sheets is provided, wherein the contact sheets include sockets which electrically connect electronic devices having pins arranged in a grid array and a board (substrate) of an electronic device. An elastic, electrically conductive sheet is provided and formed into a predetermined configuration by etching, punching out or laser processing, for example, to form the conductive material 1 shown in FIG. 1. The conductive material 1 is electrically conductive and includes a plurality of contacts 2 aligned in a linear arrangement extending in a first direction and joined to one another by a plurality of linking portions 3 that are defined by a plurality of notches formed between adjacent contacts 2 in the conductive material 1.

The contact 2 includes a base portion 22 interposed between a beam portion 23 and a securing portion 21. The base portion 22 extends from a first end to an opposed second end in the first direction and has a width extending in a second direction that is perpendicular to the first direction. The width of the base portion 22 is widest at the second end, proximate the securing portion 21, and tapers (narrows) over a distance the first direction extending toward the first end of the base portion 22 proximate the beam portion 23. At an intermediate point of the base portion 22, the tapered width becomes uniform and the width remains uniform over the distance between the intermediate point and the first end of the base portion 22.

The securing portion 21 is formed as a rectangular portion, as shown in FIG. 1, at the second end of the base portion 22. The long axis of the rectangle shape of the securing portion 21 extends from a first end to an opposed second end beyond both sides of the second end of the base portion 22 in the second direction.

The beam portion 23 is disposed at the first end of the base portion 22 and includes a first portion having a rectangular shape extending from a first end to an opposed terminal end beyond both sides of the first end of the base portion 22 in the second direction. The beam portion 23 also includes a first leg 23A extending from a first end proximate the first end of the first portion toward an opposed terminal end proximate the securing portion 21 in the first direction, and a second leg 23B extending from a first end proximate the second end of the first portion toward an opposed terminal end proximate the securing portion 21 in the first direction. It should be noted, however, that the respective terminal ends of the first and second legs 23A, 23B of the beam portion 23 do not contact the securing portion 21.

Each of the first and second legs 23A, 23B also have a width extending the second direction. The width of the first leg 23A is widest at first end thereof and tapers (narrows) over a distance the first direction extending toward the terminal end thereof. At an intermediate point on the first leg 23A, the tapered width becomes uniform and the width remains uniform over the distance between the intermediate point and the terminal end of the first leg 23A proximate the securing portion 21. The width of the second leg 23B is widest at the first end thereof and tapers (narrows) over a distance the first direction extending toward the terminal end thereof. At an intermediate point on the second leg 23B, the tapered width becomes uniform and the width remains uniform over the distance between the intermediate point and the terminal end of the second leg 23B proximate the securing portion 21.

A plurality of linking portions 3 are also provided, positioned to extend a distance in the first direction from the outer lateral side of the rectangular first portion of the beam portion 23 and from the outer lateral side of the securing portion 21 on the opposite side of the contact 2. For example, as shown in FIG. 1, a of linking portion 3 are provided between adjacent contacts, extending between the first end of the securing portion 21 of a fist contact 2 and the outer lateral side of the first end of the rectangular first portion of the beam portion 23 of the adjacent contact 2, and another linking portion 3 is provided extending between the second end of the securing portion 21 of the first contact 2 and the second end of the outer lateral side of the first rectangular portion of the beam portion 23 of the adjacent contact 2. In that manner, the linking portions 3 provide a link in the first direction between the first and second ends of the securing portion 21 of the first contact 2 in the linear arrangement and the first and second ends of the rectangular first portion of the beam portion 23 of the adjacent contact 2. It should be noted, however, that the linking portions 3 are not provided on the outermost lateral side of the rectangular first portion of the beam portion 23 for the first contact 2 arranged in the linear arrangement (on the far left as shown in FIG. 1), or on the first and second ends of outer lateral side of the securing portion 21 of the final contact 2 in the linear arrangement (not shown).

The configuration of the linking portions 3 is such that the width of linking portions 3 in the second direction is relatively small so that they are easily broken when subjected to the breaking off process (e.g., bending process) described in more detail below. It is preferred that the width of the linking portions 3 is such that the linking portions 3 can be easily broken by rupture stress in the breaking off (bending) process, and while the width is not limited, it should be preferably be 0.3 to 2 times the thickness dimension of the linking portion, and even more preferably, about 0.5 to 1 times the thickness dimension. If the width is narrower than 0.3 times the thickness dimension of the linking portion, the line will bend when the linking portions of the contacts are formed and the links will break. If the width is wider than 2 times the thickness dimension of the linking portion, the linking portions cannot be easily broken by the rupture stress in the bending process.

Further, when the electrically conductive material 1 is formed, the linking portions 3 are formed so that when the contacts 2 are formed into a predetermined configuration, as described in more detail below, a distance is provided between the opposing severed faces formed by severing (e.g., by bending) the linking portions 3 so that the opposing severed linking portions are separated from each other and the contacts and the adjacent contacts are electrically insulated.

Although substantially perpendicularly and parallel-linked lines may be formed from a plurality of contacts 2 that are linked by the linking portions 3, the configuration is not necessarily limited to the linearly interconnected contact network arrangement shown in FIGS. 1–4. For example, in the second embodiment of the present invention that is described in more detail below with reference to FIGS. 5 and 6, the arrangement of the contacts 2 in the conductive material 1 is staggered such that the positions of adjacent contacts are off-set from one another (i.e., not a directly aligned end-to-end and side-to-side connected) to form a diagonally interconnected contact network arrangement.

In the first embodiment, the elastic, electrically conductive sheet from which the conductive material 1 is formed preferably has spring characteristics and conductivity. Spring characteristics refers to the property whereby when a certain displacement force is applied, the material will deform, and when the displacement force is removed, the material returns the original shape. While the material for the electrically conductive material 1 is not limited, beryllium copper and nickel beryllium are preferred.

The thickness of the electrically conductive sheet from which the conductive material 1 is formed should preferably be in a range of 20 μm to 80 μm. If it is thinner than 20 μm, the desired spring function for the contacts (the minimum contact pressure to obtain stable electrical connection) may be harder to achieve. If it is thicker than 80 μm, the spring constant becomes higher and it difficult to have sufficient displacement and the difference in level between the base material sheet increases so that the electronic part may not be made suitably thin.

The electrically conductive material 1 may be plated as necessary. One example of plating the electrically conductive material includes providing a Ni base plating and then gold plating. Continuous plating with conventional electrolysis can also be performed prior to severing the linking portions. After detaching the connecting portions at the linking portions, that is, after the bending step, electroless plating must be used if plating is desired.

Figure 2:
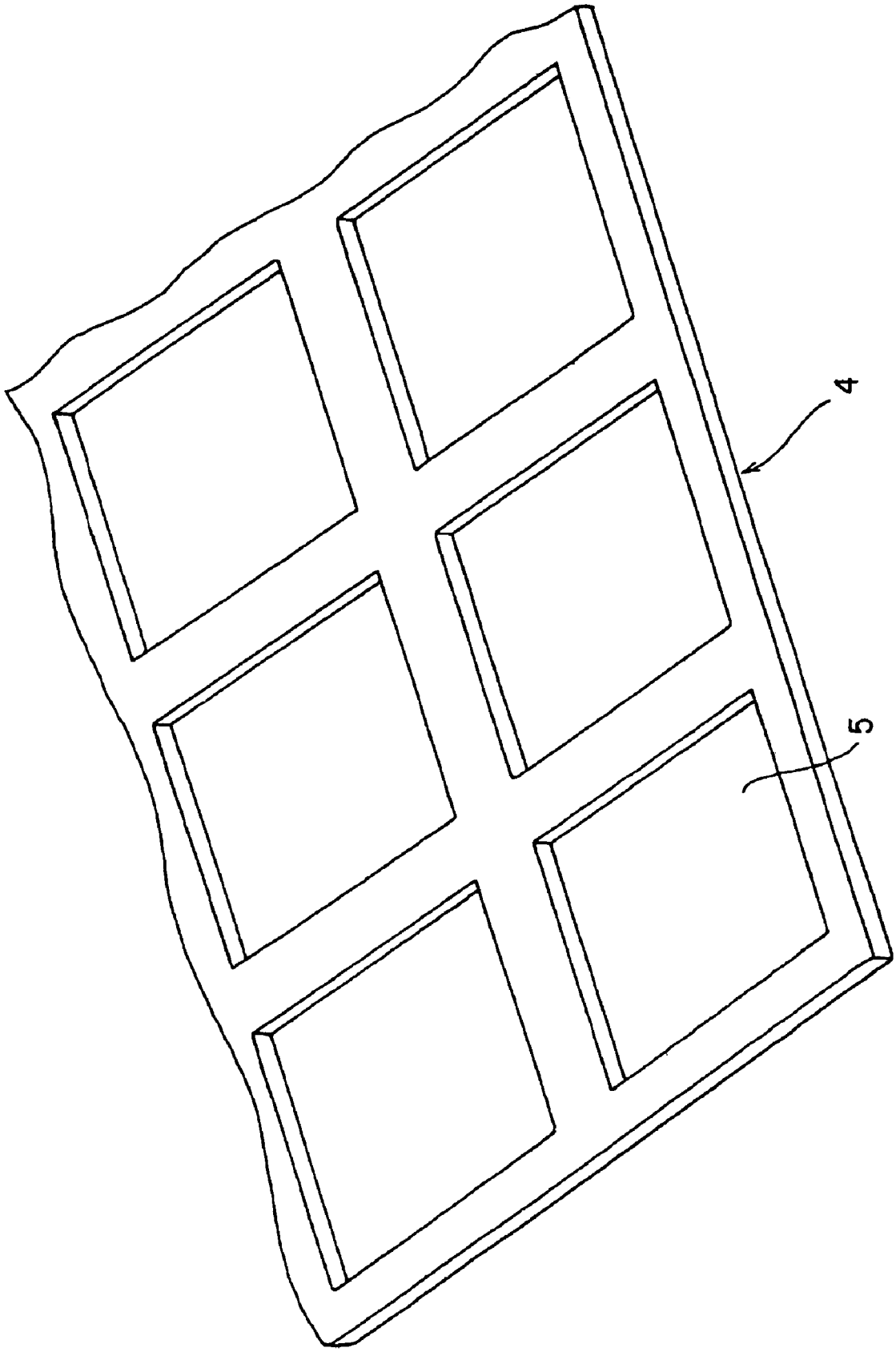
FIG. 2 is an oblique view showing a portion of the base material sheet obtained in an intermediate stage of the method of manufacturing contact sheets according to the first embodiment of the present invention.

FIG. 2 is a view of an elastic base material sheet 4 having electrically insulative properties and a plurality of cut-out openings 5 formed therein. The method of forming these openings 5 is not limited, and conventional methods may be used. The electrically conductive material 1 shown in FIG. 1 is interposed between two base sheets 4 as shown in FIG. 2 to make the structure shown in FIG. 3, wherein the electrically conductive material 1 is held by two base sheets 4. The securing portion 21 of the contact 2 is directly held by the 2 base material sheets 4. That is, since the base portion 22 and the first and second legs 23A, 23B of the beam portion 23 are arranged to be positioned in the open space of openings 5, the base portion 22 and first and second legs 23A, 23B are not directly held by the base material sheets 4. Next, the unit is bent in a bending step and a contact with the predetermined configuration is formed.

The process of securing conductive material 1 between the base material sheets 4 may be done by interposing the conductive material 1 between the base material sheets 4 and then subsequently forming the contacts into a predetermined contact configuration. Alternatively, one face of the conductive material 1 can be secured to one base sheet 4, the predetermined contact configuration can be formed, and then the other base sheet 4 can be secured to the other face of conductive material 1.

According to this embodiment, the material for base sheet 4 should be an electrically insulative material which has elasticity. While the material for the base sheet 4 is not restricted to any particular material, materials such as polyimide and liquid crystal polymers are preferred.

The thickness of base sheet 4 should be in a range of 15 μm to 75 μm. If it is thinner than 15 μm, there is the possibility that its strength may be degraded, while if it is thicker than 75 μm, then the contact sheet may not be made sufficiently thin and the necessary displacement of the contact portions of the contacts cannot be guaranteed.

Figure 3:
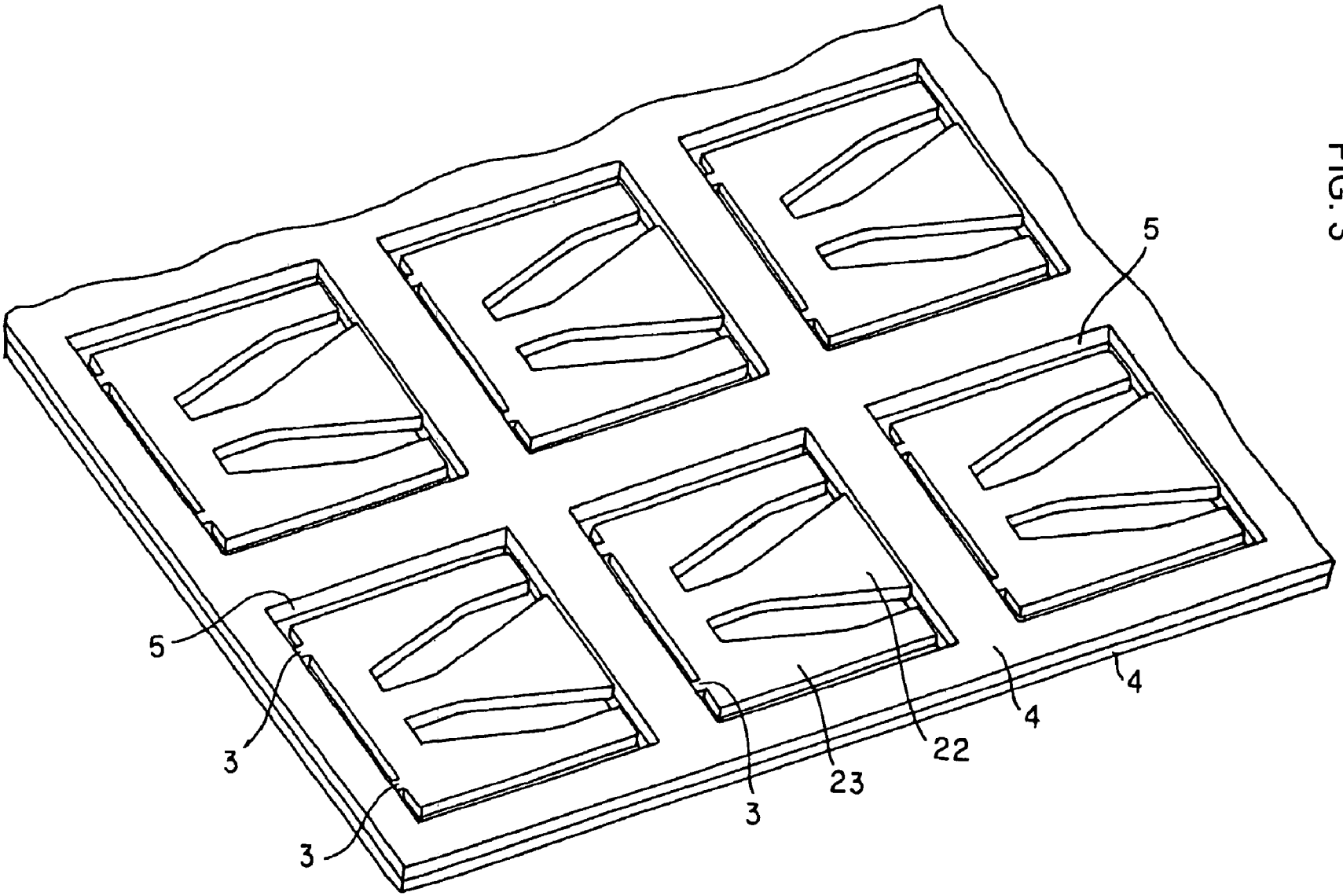
FIG. 3 is an oblique view showing a portion of the structure when the conductive material is interposed between two base material sheets.
Figure 4:
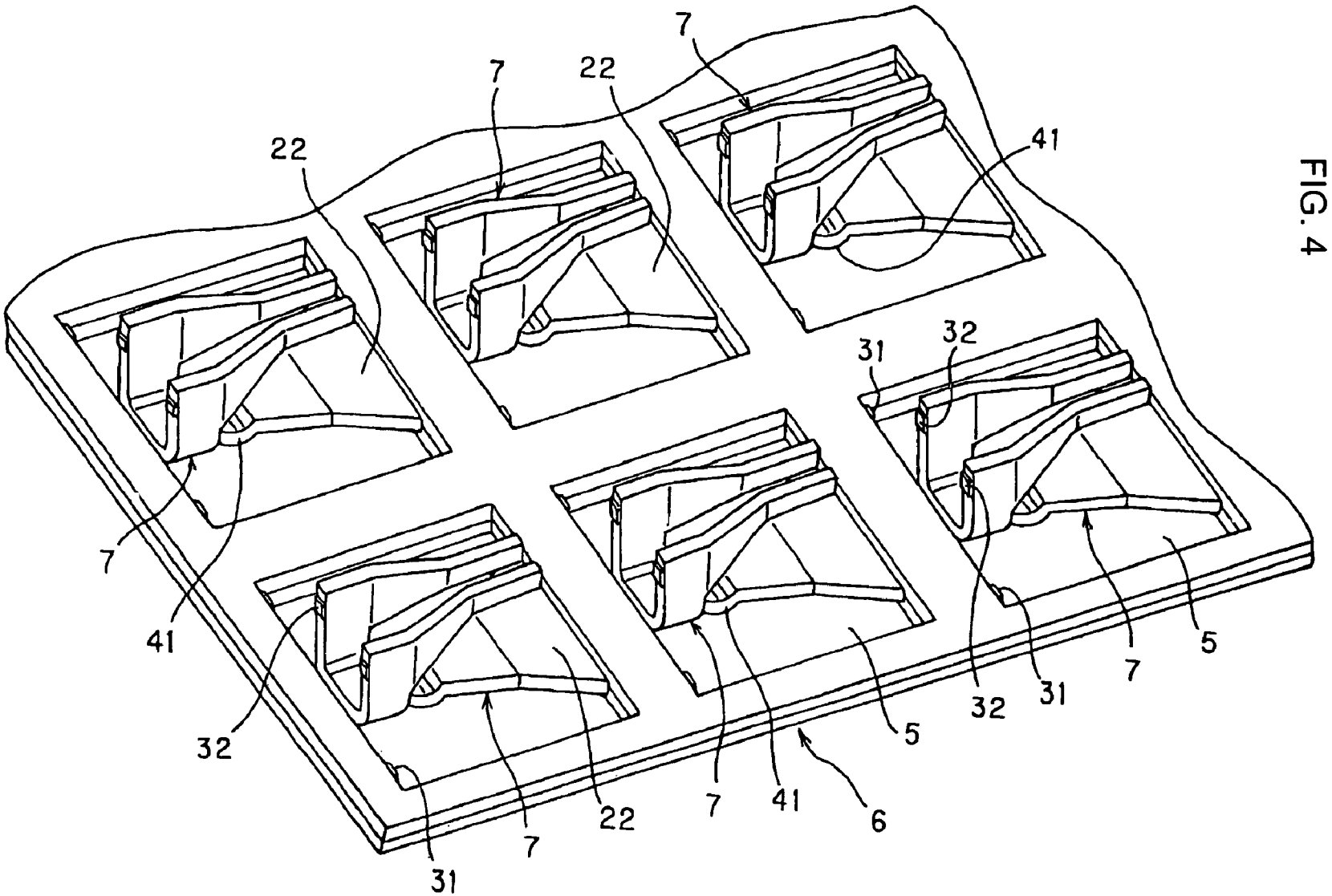
FIG. 4 is an oblique view showing a portion of the contact sheet obtained in an intermediate stage of the method of manufacturing contact sheets according to the first embodiment of the present invention.

After preparing the structure in which the electrically conductive material 1 is held by the two base sheets 4 shown in FIG. 3, the contact sheet 6 shown in FIG. 4 is prepared by subjecting this structure to a breaking off process (e.g., bending processing). The contacts 7 of the contact sheet 6 are formed by bending the base portion 22 and the first and second legs 23A, 23B shown in FIG. 3 into a predetermined configuration, as shown in FIG. 4. Due to the rupture stress generated in linking portions 3 during this bending processing, the linking portions 3 are severed from the contact members without causing the securing portion 21 to separate from the base sheet 4. At this time, as shown in FIG. 4, the opposite severed faces of the linking portions 3, that is, the severed face 31 (securing portion side) and the severed face 32 (beam side), are electrically insulated from one another and from the contact by virtue of the configuration of the contact 7 and are in a position where they will contact the contact again. That is, the positions of the linking portions 3 described above is such that, after the linking portions are severed, the severed faces 31 and 32 are electrically insulated from one another and from the contact 7 due to the bent configuration of contact 7

In making the contact 7 of the contact sheet 6 shown in FIG. 4, first, the base portion 22 of the contact 7 is bent near the center in a third direction, that is, in a direction perpendicular to the plane formed by the contact 2. In addition, the base portion 22 is bent near the first end thereof in the third direction to form a projecting portion 41 (i.e., extending downwardly) facing the opposite direction. Then, the first and second legs 23A, 23B are bent in a direction (i.e., upwardly) that is the opposite of the direction in which the protruding portion 41 extends so that the face planes of the first and second legs 23A, 23B are nearly perpendicular to the face plane of the un-bent contact 2 (i.e., the plane of the conductive material 1).

Further, the distance between the faces of t the first and second legs 23A, 23B gradually becomes smaller as the widths of the first and second legs 23A, 23B taper as described above, and then the distance between the face planes of the first and second legs 23A, 23B becomes uniform at the respective intermediate points where the widths of the first and second legs 23A, 23B is uniform out to terminal ends of the first and second legs 23A, 23B.

A contact sheet manufactured as described above is in incorporated in a frame body and is used as a Pin Grid Array socket to which electronic devices which have pins can be suitably connected and disconnected. By plugging the pins of the electronic device between the opposing first and second legs 23A, 23B, and by virtue of the protruding portion 41 extending from the opposite side of the base portion 22 that contacts a board of an electronic device, an electronic device and a board are electrically connected.

According to a second embodiment of the present invention, a method of manufacturing contact sheets is provided, wherein the contact sheets are used in a socket which electrically connects electronic devices having numerous lines of spherically shaped or pins terminals and the substrate of an electronic device.

The method of manufacturing contact sheets according to the second embodiment is similar to that of the first embodiment in that first, an elastic, electrically conductive sheet is provided and formed into a predetermined configuration by etching, punching or laser processing, for example, to form the conductive material 1. The material, thickness and application of plating to the electrically conductive sheet are the same as described above in the first embodiment. The conductive material 1 is electrically conductive, and includes a plurality of contacts 2 aligned in a staggered manner to form a diagonal contact network arrangement and joined to one another by a plurality of linking portions 3 that are defined by a plurality of notches formed between adjacent contacts 2 in the conductive material 1.

Figure 5:
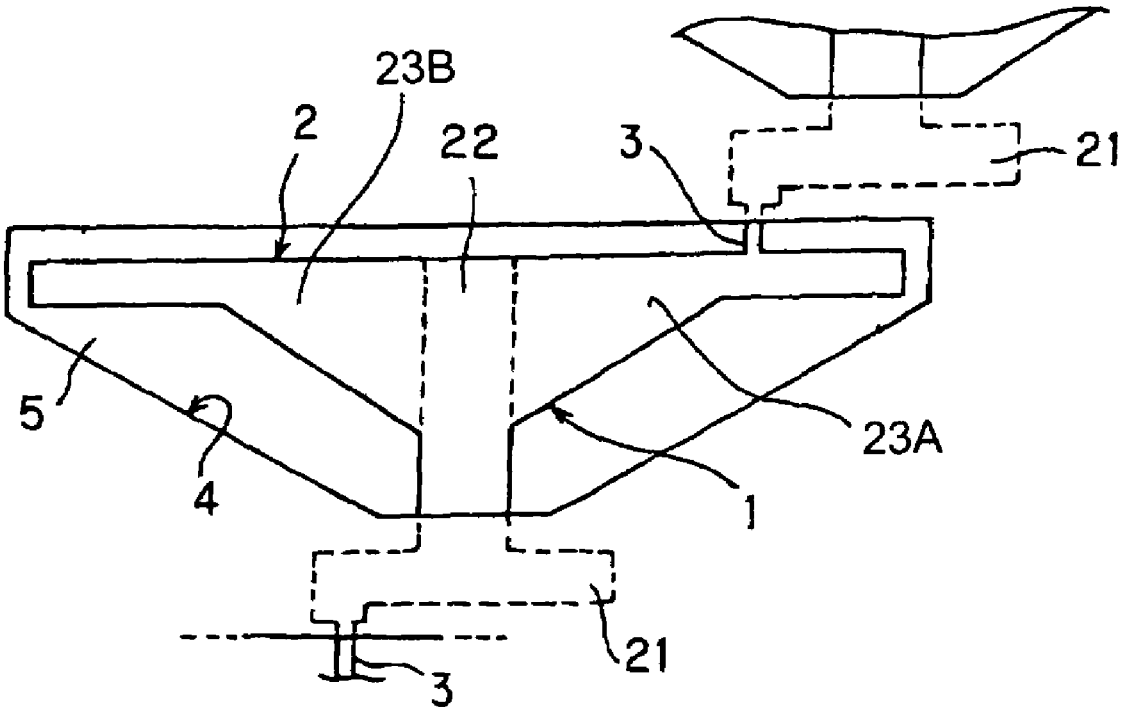
FIG. 5 is an enlarged planar view showing a portion of the structure when the conductive material is interposed between two base material sheets in an intermediate stage of the method of manufacturing contact sheets according to a second embodiment of the present invention.

The contact 2 includes a base portion 22 interposed between a beam portion 23 and a securing portion 21. The securing portion 21 is substantially the same as that described above with respect to FIG. 1. The beam portion 23 of the contact 2 according to the second embodiment of the present invention, however, does not include the rectangular first portion described above with respect to FIG. 1. Instead, as shown in FIG. 5, the beam portion 23 includes a first leg 23A and a second leg 23B, each extending from a respective first end located at opposite sides of the first end of the base portion 22, toward a respective terminal end in the second direction. The first and second beam legs 23A and 23B each have a width extending in the first direction, wherein the width is widest at the portion of the respective beam leg 23A, 23B that is closest to the base portion 22. The widths of each beam leg 23A, 23B taper (narrows) toward a respective intermediate point where the width becomes uniform, such that the beam legs 23A, 23B each have uniform widths between the respective intermediate points and the respective terminal ends thereof.

As shown, the linking portions 3 are provided on each contact 2 to provide a connecting link, for example, between the first beam leg 23A of one contact portion 2, proximate the intermediate point thereof, and the second end of the securing portion 21 of an adjacent contact 2. In that manner, the arrangement of the contacts 2 in the conductive material 1 is staggered and substantially diagonal rows are formed rather than the linear row alignment shown in FIG. 1.

Next, in the same way as the first embodiment, the electrically conductive material 1 is interposed between the two base sheets 4. The material and thickness of the base sheets 4 may be the same as those described above for the first embodiment.

Figure 6:
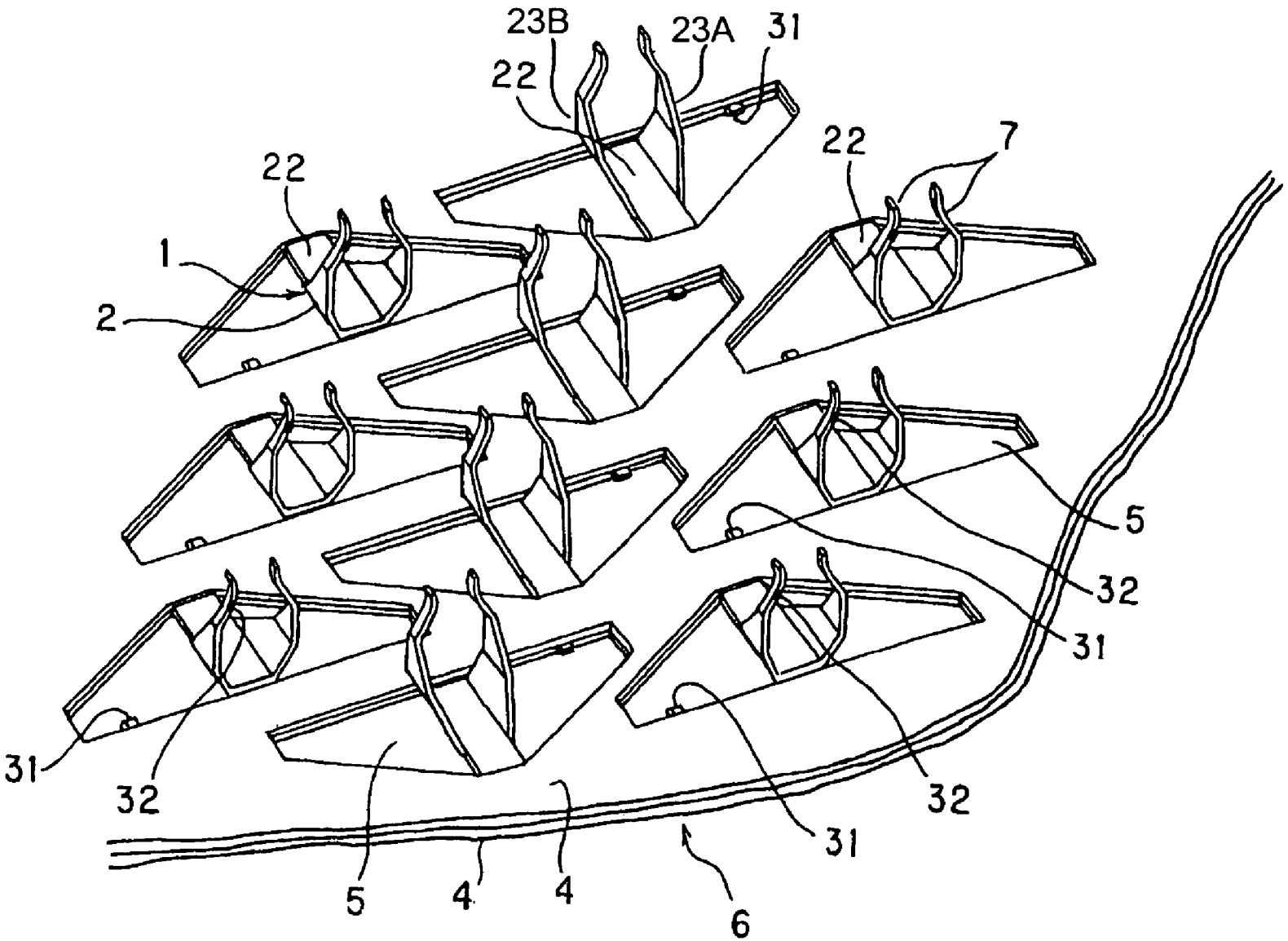
FIG. 6 is an oblique view showing a portion of the contact sheet according to a second embodiment of the present invention.

According to the second embodiment, the base sheets 4 include a plurality of cut-out openings 5 formed therein to form the structure shown in FIG. 5, wherein the electrically conductive material 1 is held by two base sheets 4. The cut-out openings 5 shown in FIGS. 5 and 6 are formed in a polygonal shape that is roughly triangular with squared-off corners. The shape of the opening 5 is not critical, so long as the beam legs 23A, 23B and the base portion 22 of the contact 2 can be positioned within the opening 5 of the cut-out portion. Further, the openings 5 are formed in a staggered arrangement, such that the staggered arrangement of the contacts 2 of the conductive material 1 corresponds to the position of the openings to facilitate the structural arrangement shown in FIGS. 5 and 6 when the conductive material is interposed between the two base sheets 4.

After preparing the structure in which the electrically conductive material 1 is held between the two base sheets 4 shown in FIG. 5, the contact sheet 6 shown in FIG. 6 is prepared by subjecting this structure to a breaking off process (e.g., bending processing). The contacts 7 of the contact sheet 6 are formed by bending the beam legs 23A, 23B of the beam 23 shown in FIG. 5 into the predetermined configuration shown in FIG. 6. Due to the rupture stress generated in linking portions 3 during this bending processing, the linking portions are severed from the contacts but the securing portion 21 is not separated from the base sheet 4. As shown in FIG. 6, the opposite severed faces of the linking portions 3, that is, the severed face 31 (securing portion side) and the severed face 32 (beam side), are separated from one another and from the contact 7 by the processing that forms the predetermined configuration of the contact 7 and the severed faces 31, 32 are arranged in a position where they will not again contact one another or the contact 7, similar to that described above with respect to the first embodiment.

The contact sheet 6 of FIG. 6 includes a plurality of diagonal rows of contacts protruding from the surface thereof. As shown, in the contacts that are positioned in the central row, the first and second beam legs 23A, 23B are bent in the third direction at a baseline along the base portion 22 so that the right and left face planes of the first and second beam legs 23A, 23B oppose each other and face one side of the face plane formed by the electrically conductive material 1. In the contacts that are positioned in the diagonal rows on either side of the central row, the first and second beam parts beam legs 23A, 23B are bent in two places (i.e., at the base line with the base portion 22 and at the intermediate point) so that the terminal ends of each beam leg 23A, 23B protrude toward to the other beam part.

A contact sheet manufactured in this way is configured to hold a spherical terminal (e.g., for a BGA: Ball Grid Array) or a pin terminal (PGA: Pin Grid Array) so that it is grasped by the opposing beam legs 23A, 23B. Such a contact sheet can be suitably used as a socket or contact board when connecting electronic devices and boards.

While methods of manufacturing contact sheets which hold spherical terminals or pin terminals of electronic devices were explained in the previously described first and second embodiments, the method of manufacturing contact sheets according to the present invention can be applied not only to the manufacture of various types of contact sheets, as well.

As discussed above, with the method of manufacturing contact sheets of this invention, because the configuration of the linking portion is such that the linking portion will sever due to the rupture stress generated in the linking portion at the time of bending, there is no need to provide another process for severing the linking portion, and the manufacturing process can be rationalized. Additionally, a contact is singulated merely by bending and severing the linking portion, that is, without a portion or all of the linking portion being removed, such that the effective size of the contact is not reduced and the contact can satisfactorily maintain spring load. Furthermore, the electrical insulation of the severed linked portions can be maintained because the positions of the linking portions prior to severing are such that a distance is provided between the opposing severed faces of the linking portions by the bending so that they are separated from and insulated from each other.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed is:

1. A method of manufacturing contact sheets, comprising the steps of:

providing at least one elastic, electrically conductive sheet;

forming an electrically conductive member from each said at least one electrically conductive sheet, each said electrically conductive member including a plurality of contact members aligned in a first direction in a predetermined arrangement and joined to one another by a plurality of linking portions;

providing at least one elastic, electrically insulative base sheet having a plurality of openings formed therein in a predetermined pattern corresponding to said predetermined arrangement of said contact members of said electrically conductive member;

positioning and securing said electrically conductive member to at least one surface of said at least one base sheet such said contact members are positioned in said openings; and subjecting said contact members to a breaking off process to sever said linking portions and separate adjacent contact members from each other;

wherein opposing severed faces of said linking portions are formed during said severing part of said subjecting step; and wherein the position of said linking portions prior to severing is such that said opposing severed faces are separated from each other.

2. The method of claim 1, wherein said breaking off process of said subjecting step comprises a bending process to form contact portions having a predetermined configuration extending from said openings of said at least one base sheet.

3. The method of claim 1, wherein said linking portions are defined by notches positioned between adjacent contact members of said electrically conductive member.

4. The method of claim 3, wherein said step of forming said electrically conductive members from each said at least one electrically conductive sheet comprises forming a contact member base portion interposed between a contact member securing portion and a contact member beam portion.

5. The method of claim 4, wherein said step of forming said electrically conductive members from each said at least one electrically conductive sheet further comprises forming said notches defining said linking portions between portions of said contact member securing portions and said contact member beam portions of adjacent contact members.

6. The method of claim 4, wherein said step of forming said contact member beam portion further comprises forming a pair of contact member beam legs extending having a width that extends in one of said first direction and a second direction that is substantially perpendicular to said first direction and a length that extends in the other one of said first and said second directions.

7. The method of claim 6, wherein said width of each said contact member beam legs in said second direction is widest at a respective first end thereof proximate a first end of said contact member base portion.

8. The method of claim 6, wherein said width of said contact member beam legs in said first direction is widest at a respective first end thereof proximate a first end of said contact member base portion.

9. The method of claim 1, further comprising a step of plating said electrically conductive member.

10. The method of claim 9, wherein said plating is performed before said subjecting step.

11. The method of claim 1, wherein a width of said linking portion is in a range of 0.3 to 2 times a thickness of said linking portion.

12. The method of claim 1, wherein said electrically conductive sheet comprises beryllium copper.

13. The method of claim 1, wherein said step of forming an electrically conductive member from each said at least one electrically conductive sheet is performed by at least one method selected from the group consisting of punching, etching or laser processing.

14. The method of claim 1, wherein said first direction is a diagonal direction such that said predetermined pattern comprises a diagonally interconnected network arrangement of said contact members in said electrically conductive member and a corresponding diagonal network arrangement of said openings of said base sheet.

* * * * *